US007635309B2

(12) United States Patent
Akavak

(10) Patent No.: US 7,635,309 B2
(45) Date of Patent: Dec. 22, 2009

(54) GRIP ARRANGEMENT FOR GOLF CLUB

(76) Inventor: Mikidjuk L. Akavak, 60 Beaufort Drive, Kanata, ON (CA) K2L 2G3

( * ) Notice: Subject to any disclaimer, the term of this patent is extended or adjusted under 35 U.S.C. 154(b) by 62 days.

(21) Appl. No.: 11/853,919

(22) Filed: Sep. 12, 2007

(65) Prior Publication Data

US 2009/0069106 A1 Mar. 12, 2009

(51) Int. Cl.
*A63B 53/14* (2006.01)

(52) U.S. Cl. ..... 473/294; 473/300

(58) Field of Classification Search ..... 473/295–299, 473/300–303

See application file for complete search history.

(56) References Cited

U.S. PATENT DOCUMENTS 1,648,354 A * 11/1927 Lied ..... 473/206
2,445,718 A 7/1948 Sternbert, et al.
3,533,630 A * 10/1970 Monaco ..... 473/206
4,858,925 A * 8/1989 DeStefano, Jr. ..... 473/285
5,328,185 A 7/1994 Finnigan et al.
5,474,300 A 12/1995 Scalise et al.
5,595,385 A 1/1997 Jablonski
5,746,662 A 5/1998 Squire
5,795,241 A 8/1998 Peshek
6,793,589 B1 * 9/2004 Yerelian ..... 473/293

* cited by examiner

*Primary Examiner*—Stephen L. Blau
(74) *Attorney, Agent, or Firm*—Vincent Patent Agency

(57) ABSTRACT

An improved grip arrangement for a golf club. The grip arrangement comprises a grip extension that extends substantially orthogonally from the shaft of the club and oriented to be substantially parallel to the club face. The grip extension allows a golfer to hold the golf club with the wrist of the dominant hand locked. The grip arrangement further comprises a shaft grip that can be used by the subordinate hand to grip the shaft of the club. The locked wrist of the dominant hand provides the golfer with more consistent and accurate shots. The improved grip arrangement is particularly well suited to use with a putter.

9 Claims, 4 Drawing Sheets

GRIP ARRANGEMENT FOR GOLF CLUB

FIELD OF INVENTION

The present invention relates to the field of clubs used for playing the game of golf. In particular, to an improved grip arrangement for a golf club.

BACKGROUND

Golf is a challenging game in which the player must make strokes of the club that are precise and repeatable. Golfers frequently miss shots when they fail to make their desired stroke with the club. While there may be many reasons why a golfer fails to make the desired stroke at least some of these reasons relate to the grip of the golf club.

In particular with regard to the putter, the conventional two-handed grip of a putter does not allow the golfer to lock his/her wrists often resulting in unintended club face movement during the stroke. In addition the conventional two-handed grip can lead to an imbalance between the dominant hand and subordinate hand.

In addition conventional golf club grips typically provide little assistance to the golfer in ensuring that the club face remains square to the intended path of the ball.

One approach to addressing difficulties in using putters is disclosed in U.S. Pat. No. 2,445,718 issued Jul. 20, 1948 to Sternberg et al. (hereinafter Sternberg et al.). Sternberg et al. disclose a putter having an extension connected to the upper end of the shaft of a putter. The extension has a cross rod with sleeves around which the remainder of the extension can pivot. The player fulcrums the club (i.e. the putter) in the left hand (for a right-hand stroke) by laying the cross bar and sleeves across the hand. The cross rod and the club head are in parallel horizontal planes. The putting stroke is made by the golfer gripping the shaft below a modified grip with his right hand and pushing the shaft. No guiding of the club is provided by the right hand after the ball has been lined up with the cup and it is only used to regulate the force of the stroke. The club swings free by the grip described and is fulcrumed and guided entirely in the left hand of the golfer. This approach puts control of the club stroke in the golfer's subordinate hand which typically can be the hand with less well developed control.

Another approach is disclosed in U.S. Pat. No. 5,595,385 issued Jan. 21, 1997 to Jablonski (hereinafter Jablonski). Jablonski discloses a putter having a conventional head, a shaft having an upper section that extends forwardly (i.e. away from the golfer) generally in the direction along a longitudinal dimension of the head, and a handle secured against rotation on that upper section of the shaft. The handle being supportable and rotatable on the hand (e.g. the left hand for a right-handed stroke) of a golfer to accommodate a pendulum-like movement of the putter head. A grip extends around and along a lower section of the shaft, the grip being adapted to be grasped by the golfer's hand (e.g. the right hand for a right-handed stroke) for imparting the pendulum-like movement of the putter head. Similarly to Sternberg et al., this approach puts control of aligning the put uniquely in the subordinate hand.

Yet another approach is disclosed in U.S. Pat. No. 3,533,630 to Monaco (hereinafter Monaco). Monaco discloses an elongated handle having a clamp member attached thereto for securing the handle to the grip of a golf club shaft. The handle forms an angle with the golf club shaft and is positioned substantially parallel to the sole of the club head. A right-handed golfer would place his right hand on the club shaft in the conventional manner and his left hand on the attached handle. In this approach the subordinate hand also provide control of alignment of the ball stroke.

What is needed is an improved grip arrangement for golf clubs that addresses the issues identified above.

SUMMARY OF INVENTION

An improved grip arrangement for a golf club. The grip arrangement comprises a grip extension that extends substantially orthogonally from the shaft of the club and oriented to be substantially parallel to the club face. The grip extension allows a golfer to hold the golf club with the wrist of the dominant hand locked. The grip arrangement further comprises a shaft grip that can be used by the subordinate hand to grip the shaft of the club. The locked wrist of the dominant hand provides the golfer with more consistent and accurate shots. The improved grip arrangement is particularly well suited for use with a putter.

In accordance with one aspect of the present invention there is provided, a grip arrangement for use on a golf club having a club head, a club face for striking a ball, and a shaft connected at one end to the club head and extending upwardly to an upper end, the grip arrangement comprising: a shaft grip, installed substantially co-axially over the upper end of the shaft, adapted to receiving the subordinate hand of a golfer; and an extension grip, attached substantially orthogonally to the shaft and sufficiently distal from the upper end of the shaft to allow the golfer's hand to grip the shaft grip, arranged such that a longitudinal axis of the extension grip intersects the shaft, extending from the shaft substantially parallel to the face; extending from the shaft in only one direction towards a toe end of the club head wherein there is only one extension grip attached substantially orthogonally to the shaft adapted to receiving the dominant hand of the golfer, wherein the dominant hand of the golfer grips the extension grip with the fourth finger proximate the shaft and the thumb distal from the shaft.

Other aspects and features of the present invention will become apparent to those ordinarily skilled in the art or science to which it pertains upon review of the following description of specific embodiments of the invention in conjunction with the accompanying figures.

BRIEF DESCRIPTION OF DRAWINGS

The present invention will be described in conjunction with drawings in which.

DETAILED DESCRIPTION

Figure 1:
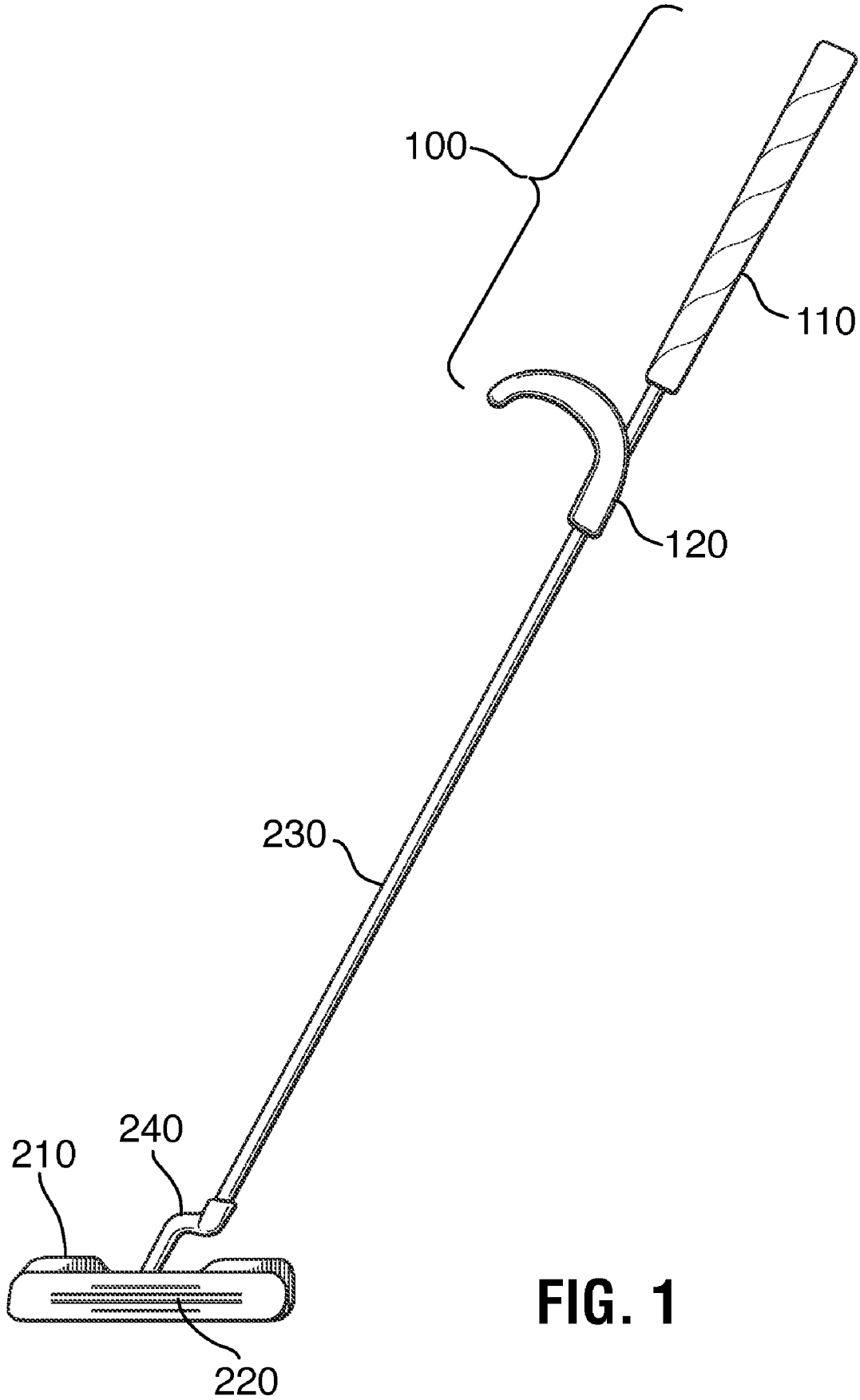
FIG. 1 is a front view of an exemplary embodiment of the improved grip arrangement on a putter.

FIG. 1 is a front view of an exemplary embodiment of the improved grip arrangement 100 on a putter. Although FIG. 1 illustrates the use of the improved grip arrangement 100 on a putter, the improved grip arrangement 100 can be used on any other golf club. References to the putter in the following description apply equally to other types of golf clubs (e.g. drivers (a.k.a. woods), irons, wedges) unless otherwise noted.

The putter (i.e. the golf club) comprises a club head 210 having a generally planar face (i.e. the club face) 220 for striking a ball and a shaft 230 attached at one end to the club head 210 and extending in a generally upward direction (in the orientation illustrated) at the other end. The shaft 230 can be straight throughout its length or alternatively can incorporate an off-set section 240 typically proximate to the attachment to the club head 210. The improved grip arrangement 100 comprises a shaft grip 110 and an extension grip 120.

The shaft grip 110 is installed substantially co-axially over an upper straight section of the shaft 230 and is similar to conventional golf club grips. The extension grip 120 extends generally orthogonally from the shaft 230 at a point sufficiently distal from the upper end of the shaft 230 to allow a golfer's hand to grip the shaft grip 110 between the extension grip 120 and the upper end of the shaft 230. The extension grip 120 can be substantially straight or alternative can be contoured to receive the golfer's dominant hand from above. The extension grip 120 can have a circular cross-section or alternatively can have a symmetrical, non-circular cross-section.

Figure 4:
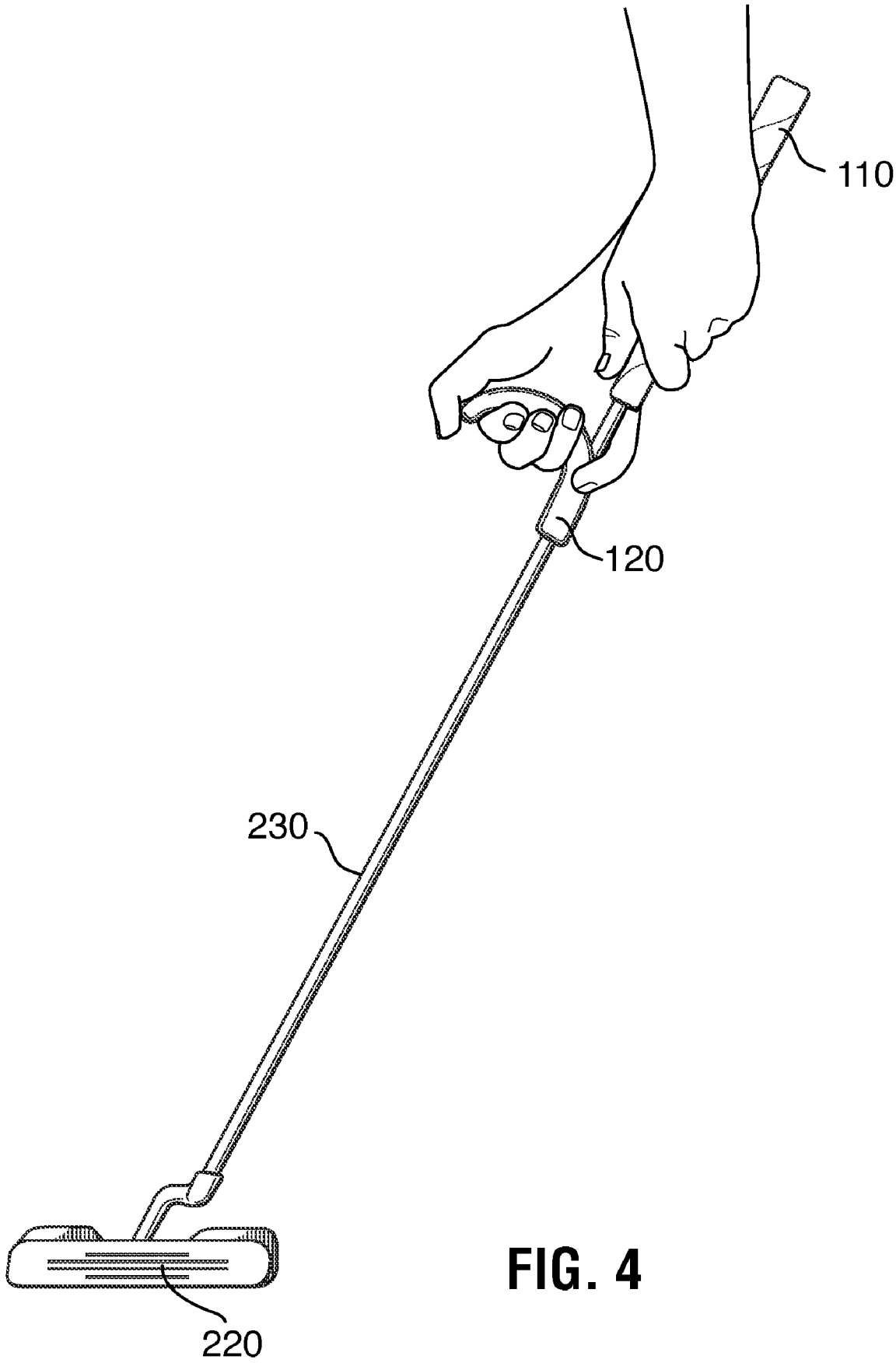
FIG. 4 is a front view of the exemplary embodiment of the improved grip arrangement of FIG. 1 illustrating a golfer's hand placement.

FIG. 4 is a front view of the exemplary embodiment of the improved grip arrangement 100 of FIG. 1 illustrating a golfer's hand placement. The length of the extension grip 120 is adapted to receiving the first three fingers of the golfer's hand. The fourth finger can be wrapped around the shaft 230 and the thumb can be placed on the end of the extension grip 120.

The extension grip 120 can be attached to the shaft 230 below the lower extremity of the shaft grip 110, preferably spaced 1.5 inches or more apart. In an alternative embodiment (not illustrated) the extension grip 120 can be attached to the shaft 230 overlapping the lower portion of the shaft grip 110.

Figure 3:
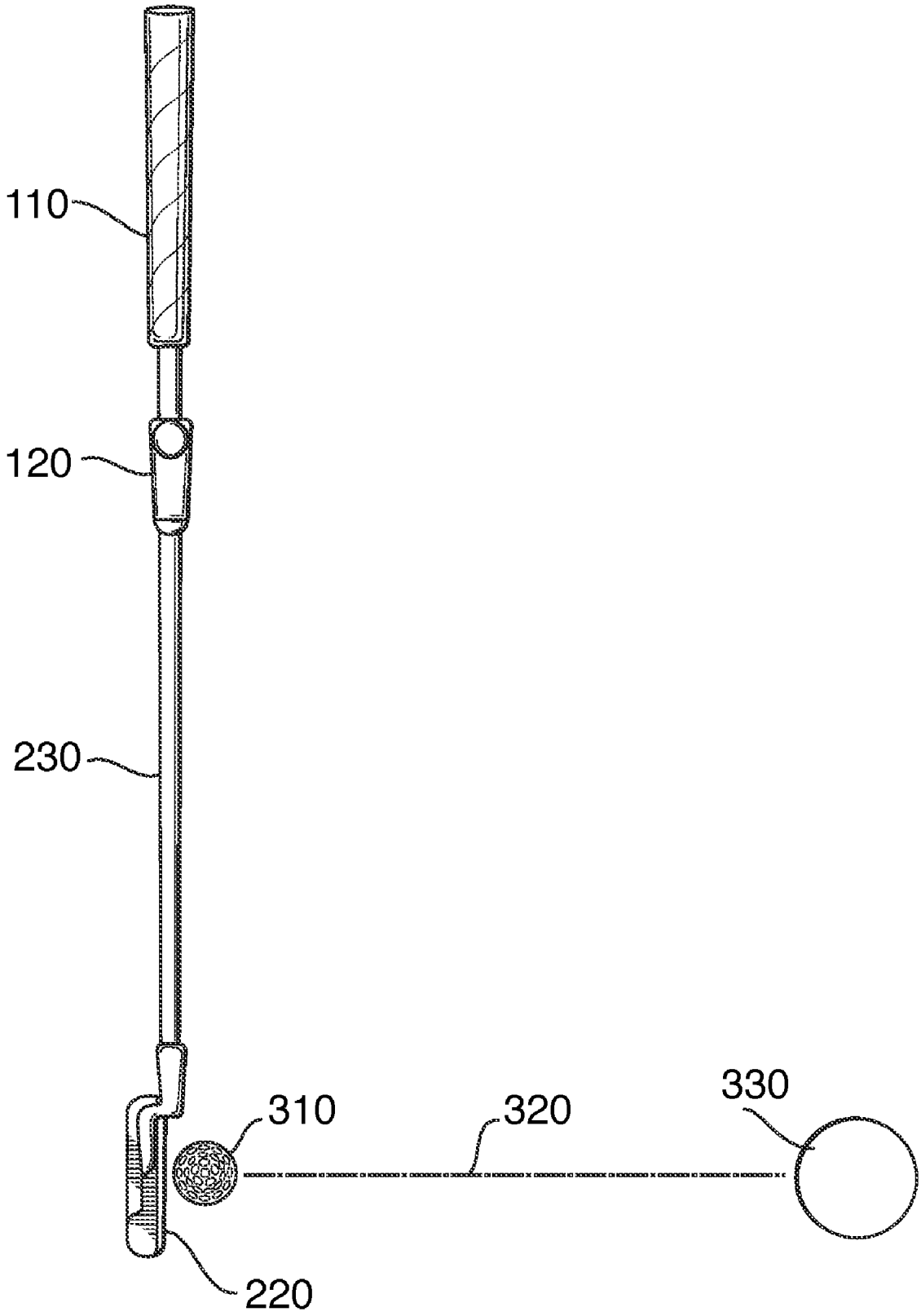
FIG. 3 is a top view of an exemplary embodiment of the improved grip arrangement on a putter.

FIG. 3 is a top view of an exemplary embodiment of the improved grip arrangement 100 on a putter. The extension grip 120 is attached to the shaft 230 such that a longitudinal axis defined by the extension grip 120 and extending generally orthogonally from the shaft 230 is substantially parallel to a plane defined by the club face 220. The golfer can use the extension grip 120 as an indicator of the orientation of the club face 220. Typically, it is preferable to align the club face 220 to be orthogonal to the intended path of ball 320. In the case of a putting stroke, the intended path 320 can be a straight line formed between the ball 310 and the hole 330 (i.e. the target).

Figure 2:
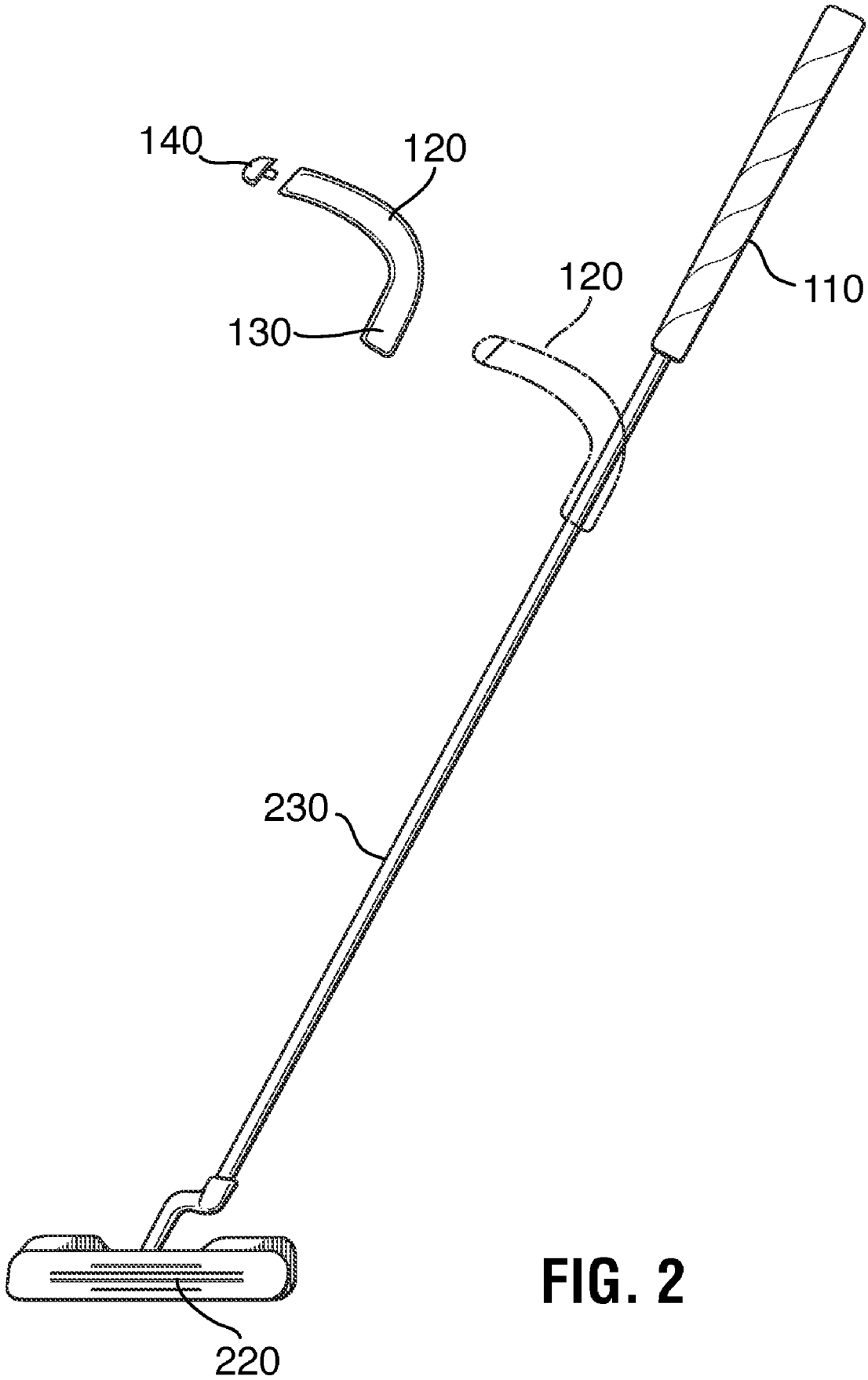
FIG. 2 is a front view of an exemplary embodiment of the improved grip arrangement on a putter with a detachable extension grip.

The extension grip 120 can be fixedly attached to the shaft 230 or alternatively the extension grip 120 can be detachable from the shaft 230 to facilitate insertion of the putter into a conventional golf bag. FIG. 2 is a front view of an exemplary embodiment of the improved grip arrangement 100 on a putter with a detachable extension grip 120. The detachable extension grip 120 can comprise a clamping mechanism or other well known releasable attachment mechanism 130 for attachment to the shaft 230. The attachment mechanism 130 can include a registration mechanism to ensure that the extension grip 120 is attached to the shaft 230 such that the longitudinal axis defined by the extension grip 120 is substantially parallel to the plane defined by the club face 220. Alternatively, the attachment mechanism 130 can be adapted to allow the extension grip 120 to be attached to the shaft 230 such that the orientation of the extension grip 120 relative to the club face 220 is determined based on the golfer's preference.

The extension grip 120 can optionally comprise a detachable ball marker 140. The ball marker 140 can be attached to the end of the extension grip 120 distal from the shaft 230 using a releasable mechanical attachment, a magnetic attachment or other similar well known releasable attachment mechanisms.

FIG. 4 illustrates the improved grip arrangement 100 in conjunction with a right-handed club (e.g. putter) and the hands of the golfer holding the club for a right-handed stroke. The improved grip arrangement 100 can also be used in conjunction with a left-handed club (not illustrated) in which case the position of the hands would be interchanged (i.e. the right hand on the shaft grip 110 and the left hand on the extension grip 120).

Use of a club having the improved grip arrangement 100 will now be described. For a right-handed club the golfer's right hand is referred to as the dominant hand and the left hand as the subordinate hand. The following description applies equally to a left-handed club with assignment of the right and left hands to the dominant and subordinate hands being interchanged. The golfer grips the shaft grip 110, using the subordinate hand, in the conventional way between the extension grip 120 and the end of the shaft 230. The golfer grips the extension grip 120 with the dominant hand using the first three fingers of the hand. The fourth finger can be wrapped around the shaft 230 as illustrated in FIG. 1. The thumb of the dominant hand can be placed over the end of the extension grip 120 distal from the shaft 230. Gripping the extension grip 120 as described above allows the golfer to achieve a natural grip and to lock the wrist of the dominant hand. The natural grip in which the wrist is not rotated in the direction of the fourth finger in order to grip the shaft 230 (as compared with a conventional grip) allows the golfer to firmly lock the wrist. The locked wrist permits the golfer to make more precise and repeatable strokes with the club. The locked wrist allows for greater accuracy in particular when used with a putter for a putting stroke (i.e. a put). The dominant hand can also be used to lift the club-head relative to the ground in order to control the elevation of the ground at which the club-head impacts the ball during a stroke of the club. The orientation of the extension grip 120 relative to the club face 220 (e.g. parallel or golfer's preference) allows the golfer to more easily ascertain and control the alignment of the club face 220 relative to the intended ball path.

In an alternative use of the improved grip arrangement 100, in particular with regard to a putter, the golfer can grip the extension grip 120 with the dominant hand as described above and not grip the club in any way with the subordinate hand. The improved grip arrangement 100 provides sufficient control of the club with the dominant hand alone to make strokes of the club. The one-handed technique for the use of a club with the improved grip arrangement 100 permits golfers who may not have full function of both hands or arms to successfully stroke the club.

The improved grip arrangement 100 can be used with a club, in particular a putter, as a learning or practice aid. The golfer uses a club with the improved grip arrangement 100 in practicing and perfecting his/her stroke with the club. Once the stroke has been perfected with the improved grip arrangement 100 the extension grip 120 can be removed (in the case of a removable extension grip 120) or the golfer can switch of similar club having a conventional grip. The muscle memory and confidence gained in perfecting the stroke with the improved grip arrangement 100 can contribute to improved performance using a conventional grip for the same or similar club.

It will be apparent to one skilled in the art that numerous modifications and departures from the specific embodiments described herein may be made without departing from the spirit and scope of the present invention.

The invention claimed is:

1. A grip arrangement for use on a golf club having a club head, a club face for striking a ball, and a shaft connected at one end to the club head and extending upwardly to an upper end, the grip arrangement comprising:

a shaft grip, installed substantially co-axially over the upper end of the shaft, adapted to receiving the subordinate hand of a golfer; and an extension grip;

attached substantially orthogonally to the shaft and sufficiently distal from the upper end of the shaft to allow the golfer's hand to grip the shaft grip;

arranged such that a longitudinal axis of the extension grip intersects the shaft;

extending from the shaft substantially parallel to the face; extending from the shaft in only one direction towards a toe end of the club head wherein there is only one extension grip attached substantially orthogonally to said shaft; and adapted to receiving the dominant hand of the golfer;

wherein the dominant hand of the golfer grips the extension grip with the fourth finger proximate the shaft and the thumb distal from the shaft.

2. The grip arrangement of claim 1, wherein the extension grip is one of:

substantially straight, and contoured to receive the golfer's hand.

3. The grip arrangement of claim 1, wherein the length of the extension grip is adapted to receive three fingers of the golfer's hand.

4. The grip arrangement of claim 1, wherein a gap along the shaft of at least 1.5 inches is formed between the shaft grip and the extension grip.

5. The grip arrangement of claim 1, wherein the extension grip is attached in overlap with the shaft grip.

6. The grip arrangement of claim 1, the extension grip farther comprising an attachment mechanism for releasable attachment to the shaft.

7. The grip arrangement of claim 6, wherein the attachment mechanism is adapted to attaching the extension grip to the shaft with an orientation between the extension grip and the club-face that is responsive to the golfer's preference.

8. The grip arrangement of claim 1, the extension grip farther comprising a detachable ball marker.

9. The grip arrangement of claim 1, wherein the extension grip has a cross-sectional profile that is one of: circular and symmetrical non-circular.

* * * * *